US011286150B2

(12) United States Patent
Drocco

(10) Patent No.: US 11,286,150 B2
(45) Date of Patent: Mar. 29, 2022

(54) DOSING MACHINE FOR DISPENSING METERED QUANTITIES OF FLUID PRODUCTS, IN PARTICULAR FOR PREPARING PAINTS, VARNISHES, DYES AND THE LIKE

(71) Applicant: DROMONT S.p.A., Grinzane Cavour (IT)

(72) Inventor: Luca Drocco, Alba (IT)

(73) Assignee: DROMONT S.p.A.

( * ) Notice: Subject to any disclaimer, the term of this patent is extended or adjusted under 35 U.S.C. 154(b) by 0 days.

(21) Appl. No.: 17/037,842

(22) Filed: Sep. 30, 2020

(65) Prior Publication Data

US 2021/0094818 A1 Apr. 1, 2021

(30) Foreign Application Priority Data

Oct. 1, 2019 (IT) ..... 102019000017645

(51) Int. Cl.
*B67D 3/00* (2006.01)

(52) U.S. Cl.
CPC ..... *B67D 3/0041* (2013.01); *B67D 3/0019* (2013.01); *B67D 3/0083* (2013.01)

(58) Field of Classification Search
CPC .. B67D 3/0041; B67D 3/0019; B67D 3/0083; B67D 3/009; B01F 15/0227; B01F 13/1055; B65D 83/14
See application file for complete search history.

(56) References Cited

U.S. PATENT DOCUMENTS 3,161,322 A * 12/1964 Stone ..... F17C 13/084 222/5
3,940,019 A * 2/1976 Kross ..... B67D 1/0041 222/30
4,467,941 A * 8/1984 Du ..... B67D 1/1245 222/1
4,967,938 A * 11/1990 Hellenberg ..... B01F 13/1058 141/104
5,156,298 A * 10/1992 LaRue ..... G01F 23/241 222/129

(Continued)

FOREIGN PATENT DOCUMENTS

EP 1534417 A2 6/2005
GB 2127778 A 4/1984

OTHER PUBLICATIONS

European Search Report dated Jun. 23, 2020. 7 pages.

*Primary Examiner* — Vishal Pancholi
*Assistant Examiner* — Bob Zadeh
(74) *Attorney, Agent, or Firm* — RMCK Law Group PLC

(57) ABSTRACT

A dosing machine for dispensing metered quantities of fluid products, in particular for preparing paints, varnishes, dyes and the like, includes: a stock having a plurality of compartments configured to receive respective sealed disposable cartridges, a dispensing head having a plurality of nozzles, and a plurality of dosing circuits configured to supply metered quantities of fluid products to respective nozzles of the dispensing head, wherein each of said dosing circuits is hydraulically connected to two cartridge supports configured to be connected to respective cartridges containing the same fluid product, so that, during operation, one of the two cartridges connected to the same dosing circuit forms a buffer for the complementary cartridge.

4 Claims, 9 Drawing Sheets

(56) References Cited

U.S. PATENT DOCUMENTS

| | | | | |
|---|---|---|---|---|
| 5,341,957 | A * | 8/1994 | Sizemore | G07F 13/065 222/105 |
| 2006/0118581 | A1* | 6/2006 | Clark | B01F 13/1066 222/333 |
| 2008/0023488 | A1* | 1/2008 | Guerrero | B67D 1/0001 222/129.4 |
| 2010/0129524 | A1* | 5/2010 | Stemberger | C09D 7/41 427/8 |
| 2021/0094818 | A1* | 4/2021 | Drocco | B67D 3/0041 |

* cited by examiner 22
24b
30a
30b
36
38
52
60
66
28

22
24a
24b
30a
30b
28
36
38
52
60
66

DOSING MACHINE FOR DISPENSING METERED QUANTITIES OF FLUID PRODUCTS, IN PARTICULAR FOR PREPARING PAINTS, VARNISHES, DYES AND THE LIKE

CROSS-REFERENCE TO RELATED APPLICATIONS

This application claims priority to Italian Patent Application No. 102019000017645 filed Oct. 1, 2019. The disclosure of the above application is incorporated herein by reference in its entirety.

FIELD OF THE INVENTION

The present invention relates to dosing machines for dispensing metered amounts of fluid products.

The invention was developed, in particular, in view of the application to dispensing machines for preparing paints, varnishes, dyes and the like.

In the following description, reference will be made to this field of use without, however, losing generality.

DESCRIPTION OF THE PRIOR ART

A dosing machine for dispensing fluid products for preparing paints, varnishes, dyes and the like, generally comprises a stock in which a plurality of containers containing respective fluid products, for example dyes, are housed, and a dispensing head having a plurality of nozzles connected to respective containers by respective dosing circuits.

The dosing circuits comprise respective metering pumps which supply metered quantities of fluid products from the containers to respective nozzles of the dispensing head.

The containers of fluid products (so-called canisters) may have different capacities, and must be filled periodically according to the consumption of the fluid products. The canisters have upper refill openings, through which the operators pour additional quantities of fluid products when the levels drop below a certain threshold.

The canisters are normally provided with respective stirring devices, which keep the fluid products in movement according to a predefined periodicity to avoid the formation of stratifications, deposits, incrustations, molds, etc.

Although this system has been used for decades, it suffers from several drawbacks, including:

- the need to periodically refill the canisters, which involves operations that are not always easy;
- manual filling of the canisters, which entails the risk of overflow of the fluid products outside the canisters;
- the lids applied on the upper openings of the canisters do not guarantee a hermetic closure;
- the fluid products contained in the canisters tend to gradually dry out, especially when they are used sporadically;
- some types of fluid products in contact with the external environment tend to form fungi and molds;
- the stirring devices associated with the canisters involve a certain degree of complexity.

The Italian patent application no. 102019000008331 by the same applicant (not yet published at the filing date of the present application) describes a dosing machine for dispensing metered quantities of fluid products, in particular, for preparing paints, varnishes, dyes and the like, comprising a dispensing head having a plurality of nozzles, a plurality of dosing circuits which feed metered quantities of fluid products to respective nozzles of the dispensing head, and a plurality of disposable sealed cartridges connected in a removable way to respective attachment bases, hydraulically connected to respective dosing circuits.

One of the major challenges to be solved in a solution using removable disposable sealed cartridges is to always ensure the completion of each dosing operation without interruptions. In particular, it is necessary to avoid interrupting the dosage in progress when replacing a cartridge. In fact, interrupting the dosage could compromise the precision and accuracy of the dosing of the dyes.

In the solution described in the Italian patent application no. 102019000008331, each cartridge is associated with a respective accumulator that contains the maximum amount of product that can be dispensed in a single dispensing, to avoid stopping the machine during the operations to replace empty cartridges. The fact of providing accumulators associated with each cartridge may increase the complexity and cost of the machine.

OBJECT AND SUMMARY OF THE INVENTION

The present invention aims to provide a dosing machine that overcomes the problems of the prior art According to the present invention, this object is achieved by a dosing machine having the characteristics forming the subject of claim 1.

The claims form an integral part of the disclosure provided here in relation to the invention.

BRIEF DESCRIPTION OF THE DRAWINGS

The present invention will now be described in detail with reference to the attached drawings, given purely by way of non-limiting example, wherein.

Figure 1:
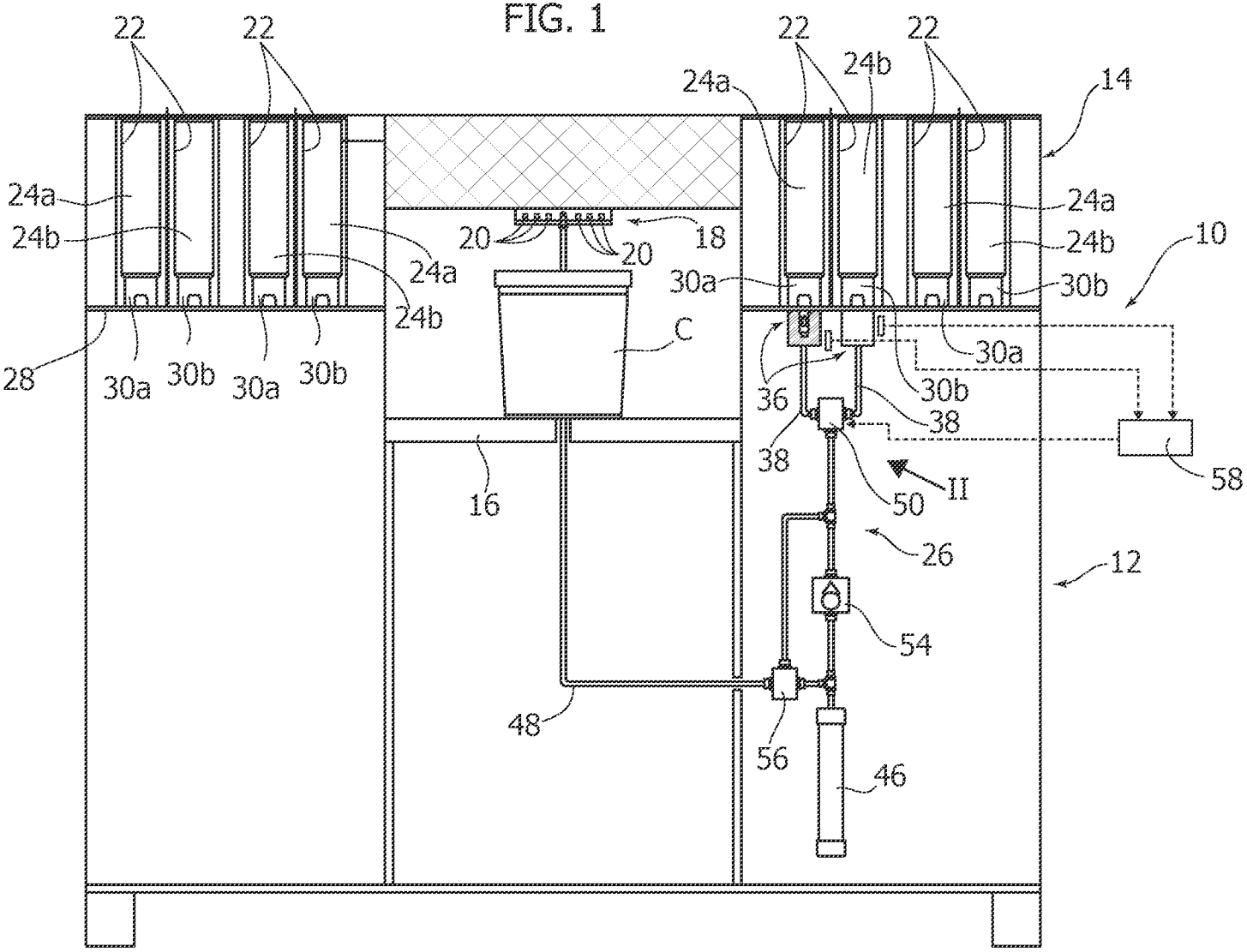
FIG. 1 is a schematic view of a dosing machine according to a first embodiment of the present invention.

It will be understood that, in the drawings, some parts have been removed for greater clarity of the representations. It will also be understood that the various figures may not be reproduced on the same scale.

DETAILED DESCRIPTION

With reference to FIG. 1, numeral 10 indicates a dosing machine for dispensing metered quantities of fluid products, in particular, for preparing paints, varnishes, dyes and the like. The dosing machine 10 comprises a frame 12 which rests on the ground, and has an upper section in which a stock 14 is formed. The frame 12 of the dosing machine 10 comprises a support 16 on which the containers C are placed in which the preparation of paints, varnishes, dyes and the like is carried out.

The dosing machine 10 comprises a dispensing head 18 provided with a plurality of nozzles 20 through which metered quantities of respective fluid products are dispensed. The fluid products dispensed by the nozzles 20 are poured into a container C resting on the support 16.

A plurality of compartments 22 are formed in the stock 14 of the dosing machine 10 in which a plurality of disposable sealed cartridges 24*a*, 24*b* containing fluid products, for example dyes for preparing varnishes, are housed. The cartridges are grouped in pairs and each pair of cartridges 24*a*, 24*b* contains the same fluid product, for example, the same dye. The dosing machine may comprise a number of pairs of cartridges ranging from eight to thirty-two.

The dosing machine 10 comprises a plurality of dosing circuits 26, each of which is connected to a respective nozzle 20 of the dispensing head 18.

Each pair of cartridges 24*a*, 24*b* is connected to the same dosing circuit 26.

Figure 2:
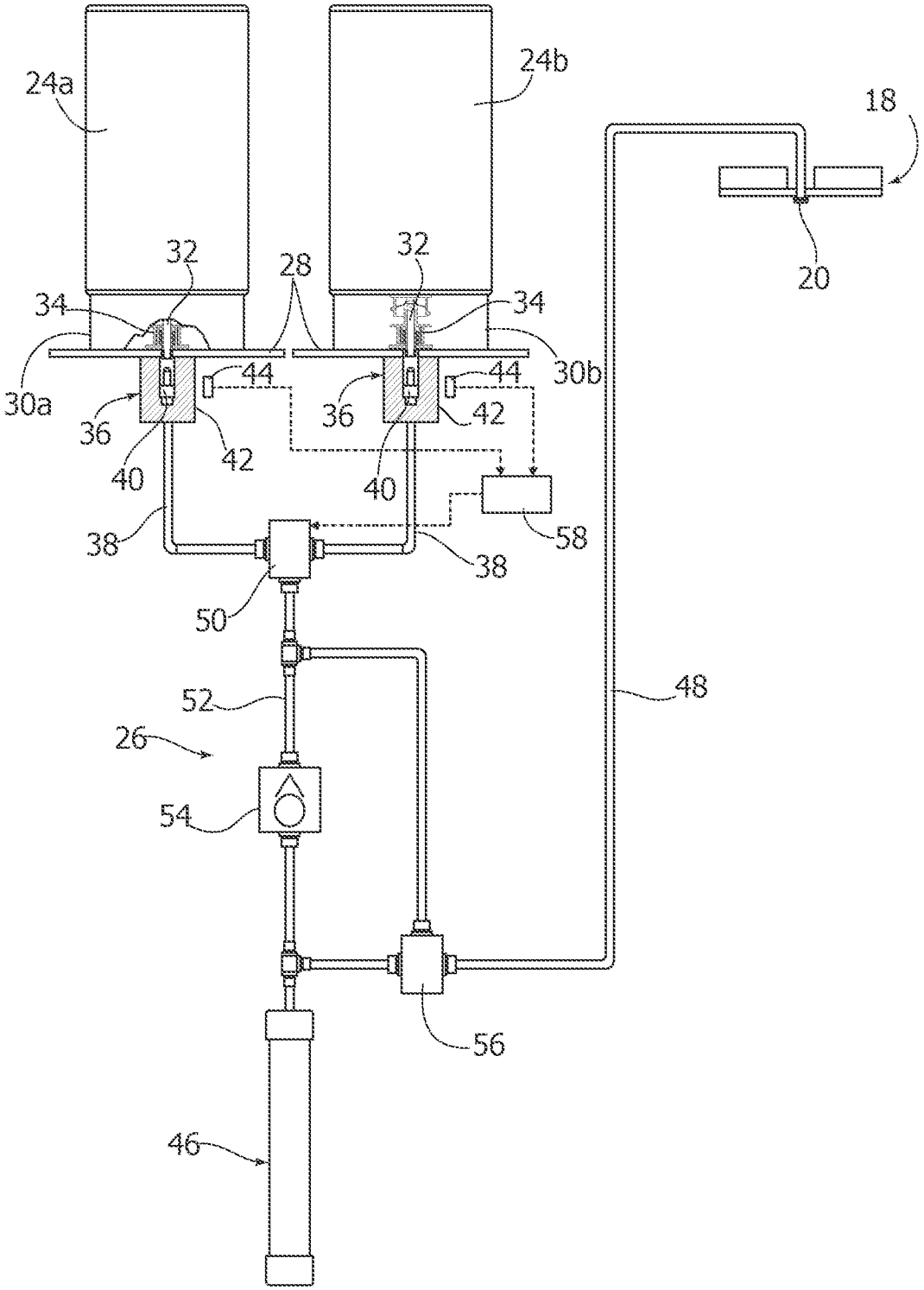
FIG. 2 is a schematic view on an enlarged scale of a dosing circuit indicated by the arrow II in FIG. 1.
Figure 3:
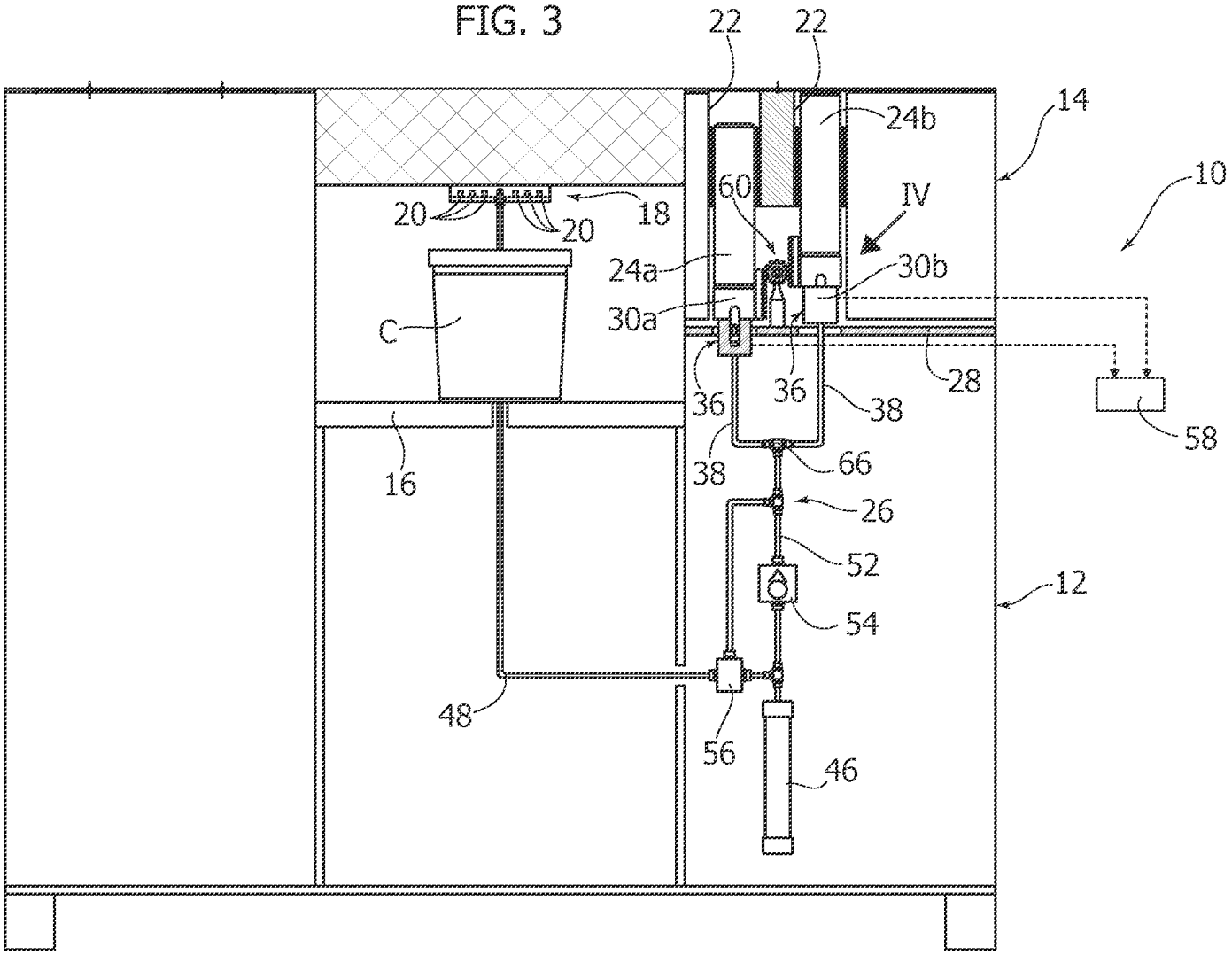
FIG. 3 is a schematic view of a second embodiment of a dosing machine according to the present invention.

With reference to FIGS. 1 and 2, the frame 12 of the dosing machine 10 has a horizontal plate 28 which carries a plurality of cartridge supports 30*a*, 30*b*, each of which is configured to receive a respective cartridge 24*a*, 24*b*. The disposable sealed cartridges 24*a*, 24*b* are removably connected to the respective cartridge supports 30*a*, 30*b*.

In the embodiment illustrated in FIGS. 1 and 2, the cartridge supports 30*a*, 30*b* are fixed with respect to the horizontal plate 28 of the frame 12 of the dosing machine 10.

Each of the cartridge supports 30*a*, 30*b* is configured for:

- allowing the sealing connection of the respective cartridge 24*a*, 24*b* to the respective dosing circuit 26,
- supporting the cartridge 24*a*, 24*b* in the correct vertical position and allowing easy emptying,
- perforating a sealing membrane of the cartridge when inserting a new cartridge 24*a*, 24*b*, and
- avoiding the entry of air into the dosing circuit 26 during the operations of insertion, use and extraction of the cartridge 24*a*, 24*b*.

For example, each cartridge support 30*a*, 30*b* may comprise a tubular pin 32 configured to pierce a membrane of the cartridge 24*a*, 24*b*, and a sealing element 34 pressed against the edge of a mouth of the cartridge.

Each cartridge support 30*a*, 30*b* may be associated with a respective level sensor 36 which can be arranged on a tube 38 that hydraulically connects the cartridge support 30*a*, 30*b* to the dosing circuit 26. In one embodiment, the level sensor 36 could comprise a magnetic floater 40 movable inside a body 42 and cooperating with an outer detector 44 that detects the vertical position of the floater 40 inside the body 42.

Each dosing circuit 26 may comprise a respective metering pump 46, which can be driven by a respective electric motor. The metering pump 46 may be connected to a respective nozzle 20 of the dispensing head 18 via an outlet tube 48. Each dosing circuit 26 may comprise a first three-way valve 50, which causes one or the other of the two tubes 38 to communicate with a third tube 52 connected to the metering pump 46. A non-return valve 54 may be arranged on the third tube 52. Each metering circuit 26 may comprise a second three-way valve 56 for switching the dosing circuit 26 between a dispensing mode and a recirculation mode. The first three-way valve 50 may be controlled by a control unit 58 according to the signals supplied by the level sensors 36.

As previously indicated, the two cartridges 24*a*, 24*b* connected to the same dosing circuit 26 contain the same fluid product, for example, the same dye. The control unit 58 of the dosing machine 10 drives the three-way valve 50 of each dosing circuit 26 to allow the dispensing of fluid product from only one of the cartridges 24*a* or 24*b* of each pair. The control unit 58 switches the dispensing towards the second cartridge of the pair only following the complete emptying of the first cartridge, and vice versa. In this way, when one of the two cartridges 24*a*, 24*b* is finished, dispensing continues by withdrawing the fluid product from the full cartridge. In the meantime, an operator replaces the empty cartridge with a new full cartridge, which remains in reserve for the cartridge from which the fluid product is dispensed. In this way, stopping of the dosing machine is avoided during the replacement operations of the empty cartridges.

The fact that each dosing circuit 26 is connected to two cartridges 24*a*, 24*b* containing the same fluid product, for example, the same dye, causes one of the two cartridges to form a reserve buffer for the other cartridge, so that when a first cartridge is finished, the dosing circuit 26 can continue dispensing the fluid product by taking it from the second cartridge.

In the embodiment illustrated in FIGS. 1 and 2, the dosing circuit 26 withdraws the fluid product from only one of the cartridges 24*a*, 24*b* of the pair. In an alternative embodiment, the dosing machine 10 may be configured so that each dosing circuit 26 withdraws the fluid product simultaneously from both cartridges 24*a*, 24*b* of the pair of cartridges associated therewith. One such arrangement is illustrated in FIGS. 3-15. In the embodiment illustrated in FIGS. 3-15, the elements corresponding to those previously described are indicated with the same numerical references.

In this second embodiment, the cartridge supports 30*a*, 30*b* are movable in a vertical direction between a raised position and a lowered position. The two cartridge supports 30*a*, 30*b* connected to the same dosing circuit 26 are connected to each other by means of a transmission device 60, configured in such a way that when a first cartridge support 30*a* is in the lowered position, the second cartridge support 30*b* is in the raised position, and vice versa.

Figure 4:
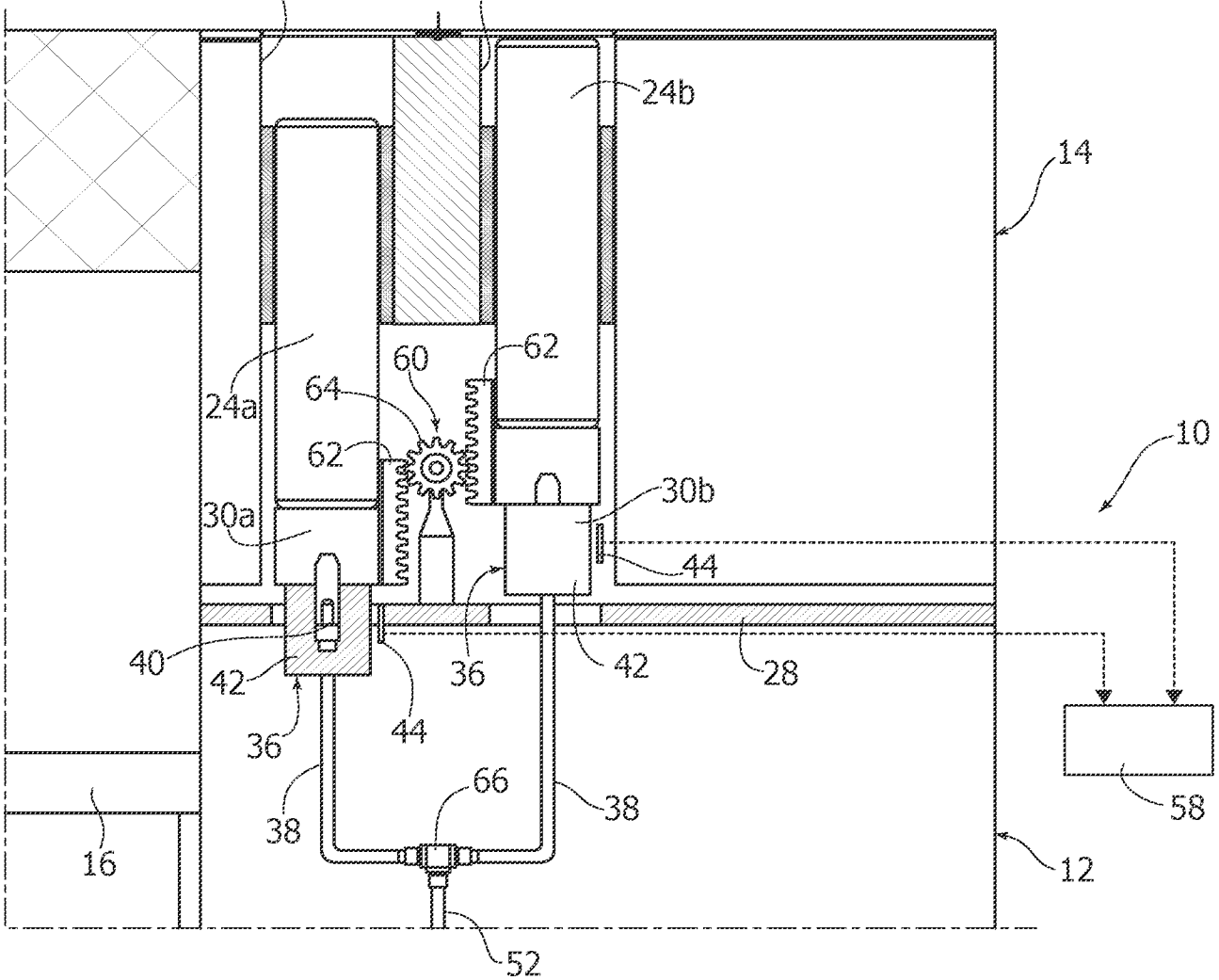
FIG. 4 is a schematic view on an enlarged scale of the part indicated by the arrow IV in FIG. 3, FIGS. 5-10 illustrate the assembly sequence of the cartridges in the dosing machine of FIG. 3, FIGS. 11 and 12 are schematic views illustrating some steps of operation.

With reference to FIG. 4, in a possible embodiment, the transmission mechanism that connects the cartridge supports 30*a*, 30*b* of each pair to each other may comprise two vertical racks 62 fixed to respective cartridge supports 30*a*, 30*b* and cooperating with a gear 64 rotatable around a fixed horizontal axis. The transmission device 60 may be provided with a stop device which blocks the cartridge supports 30*a*, 30*b* in the two limit positions in which one of the two cartridge supports 30*a*, 30*b* is in the lowered position and the other cartridge support 30*a*, 30*b* is in the raised position. The transmission mechanism 60 can be made using transmission components of a type other than those illustrated, for example, by means of levers or flexible transmission members. In general, any device that produces an upward movement of one of the two cartridge supports 30*a*, 30*b* following a downward movement of the other cartridge support 30*a*, 30*b* of the same pair can be used.

As in the embodiment illustrated above, the respective disposable sealed cartridges 24*a*, 24*b* containing the same fluid product, for example, the same dye, are engaged onto each of the two cartridge supports 30*a*, 30*b* of the same pair. Each of the two cartridge supports 30*a*, 30*b* comprises a respective level sensor 36 and is connected to a respective outlet tube 38. The two outlet tubes 38 are connected to a third tube 52 connected to the metering pump 46. In this embodiment, the two tubes 38 can be flexible and are both connected directly to the tube 52 by means of a three-way connector 66. In this embodiment, a three-way valve is not provided between the two tubes 38 and the third tube 52. In this case, the signals supplied by the level sensors 36 serve only to signal the state of emptiness of the respective cartridges.

The exchange of the high/low position between the two cartridges 24*a*, 24*b* of the same pair may be carried out by applying a manual action on one of the two cartridges. The movement of the cartridges 24*a*, 24*b* could also be servo-assisted. In any case, the movement from the raised position to the lowered position, and vice versa, of the two cartridges 24*a*, 24*b* is carried out exclusively upon insertion of a new full cartridge to replace an empty cartridge. The new just-inserted cartridge always assumes the low position while the other cartridge of the same pair assumes the high position. There are no intermediate stable positions between the low position and the high position. When the cartridges are in the intended position (one in the low position and the other in the high position), a mechanical stop or a magnetic lock blocks the transmission mechanism 60 in the position that has been reached.

The difference in height between the two cartridges 24*a*, 24*b* must be such that the volume of the fluid product contained in the lower cartridge between the bottom of the lower cartridge itself, and the level corresponding to the bottom of the upper cartridge is at least equal to the maximum volume to be dispensed in the case of the volumetrically worst formula.

The cartridge in the lower position forms the buffer of the cartridge of the same pair in the upper position, in each case.

Figures 5, 6, 7:
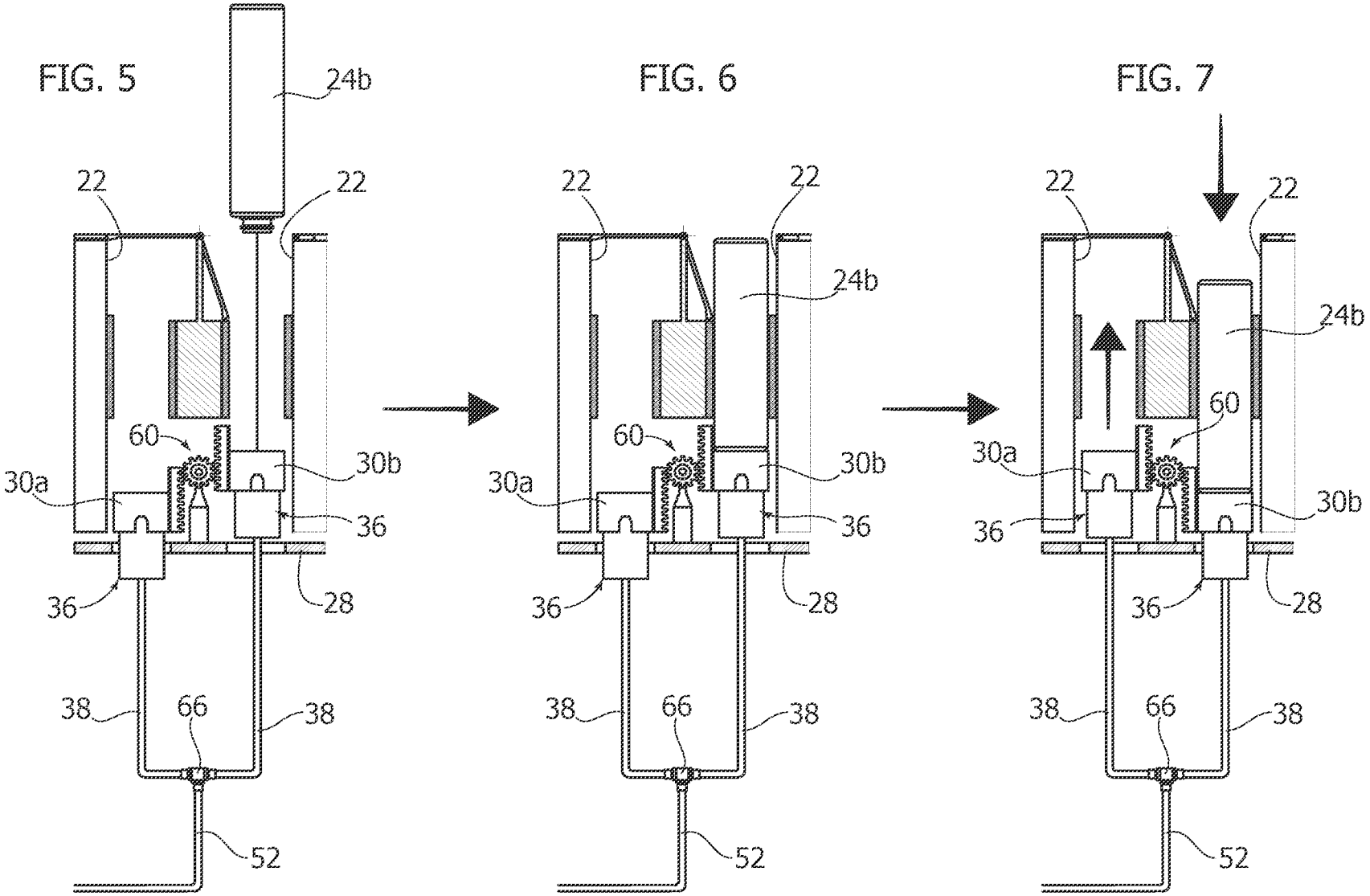
Figures 8, 9, 10:
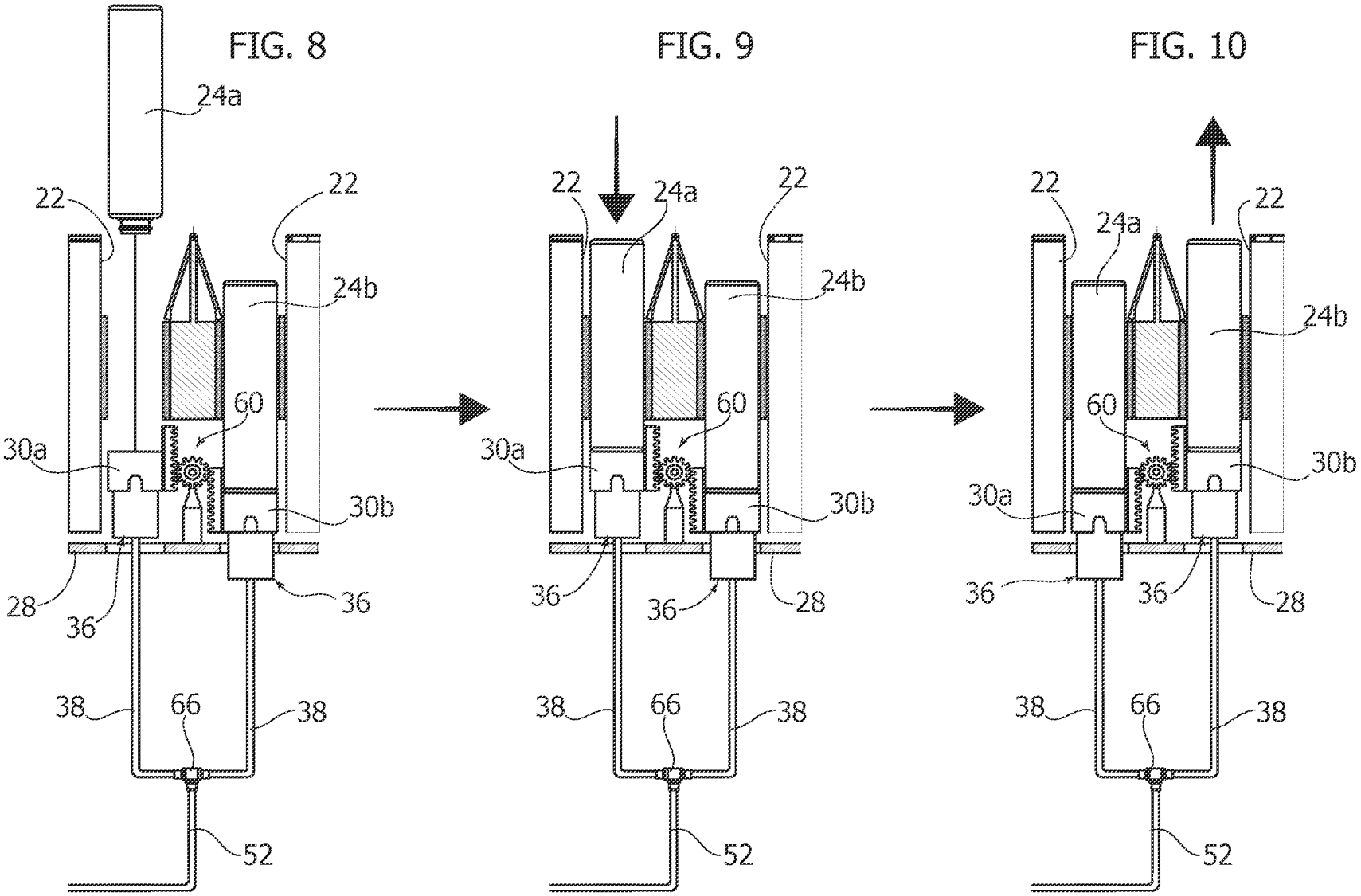

FIGS. 5-10 illustrate the sequence for installing new cartridges on a machine that was initially devoid of cartridges. With reference to FIG. 5, a cartridge 24*b* is engaged on the cartridge support 30*b*, which is in the raised position. After inserting the cartridge 24*b* into the respective compartment 22, the cartridge 24*b* is pushed downwards so as to push down the cartridge support 30*b*, and at the same time move the cartridge support 30*a* upwards. During the downward thrust of the cartridge 24*b*, the seal of the cartridge located at the outlet mouth of the cartridge is perforated, and the fluid product located inside the cartridge 24*b* flows by gravity into the respective tube 38. At this point, the cartridge 24*a* is inserted into the respective compartment 22 and is engaged on the respective cartridge support 30*a* which is in the raised position (FIGS. 8 and 9). The cartridge 24*a* is pushed downwards to complete the engagement on the respective support 30*a* (FIG. 10) and in doing this, the cartridge 24*a* is brought into the lowered position and—at the same time—the cartridge 24*b* is brought into the highest position as illustrated in FIG. 10.

Figure 12:
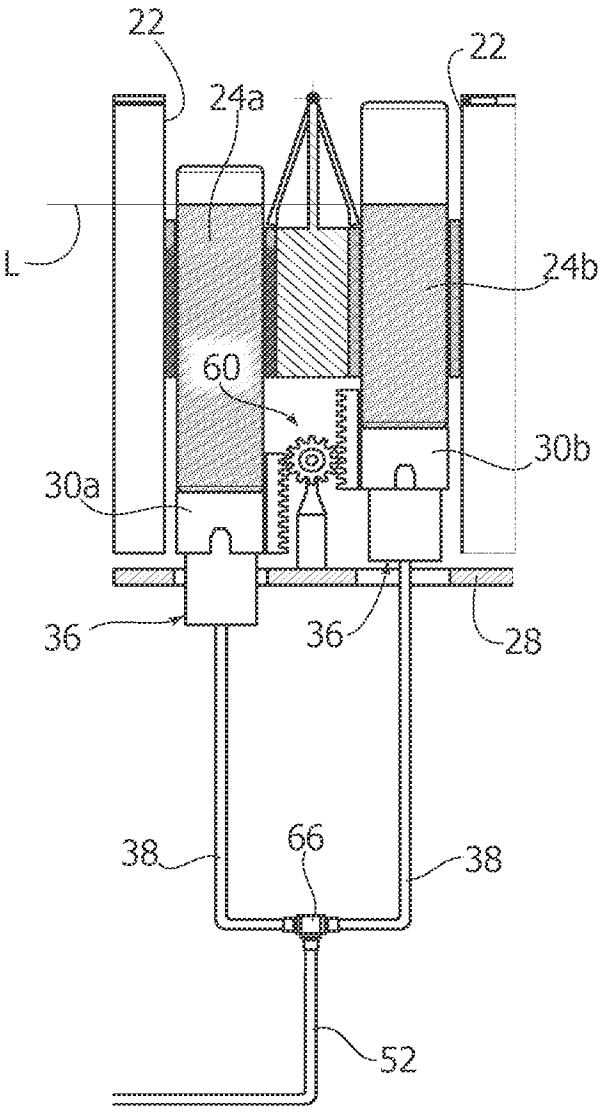
Figure 11:
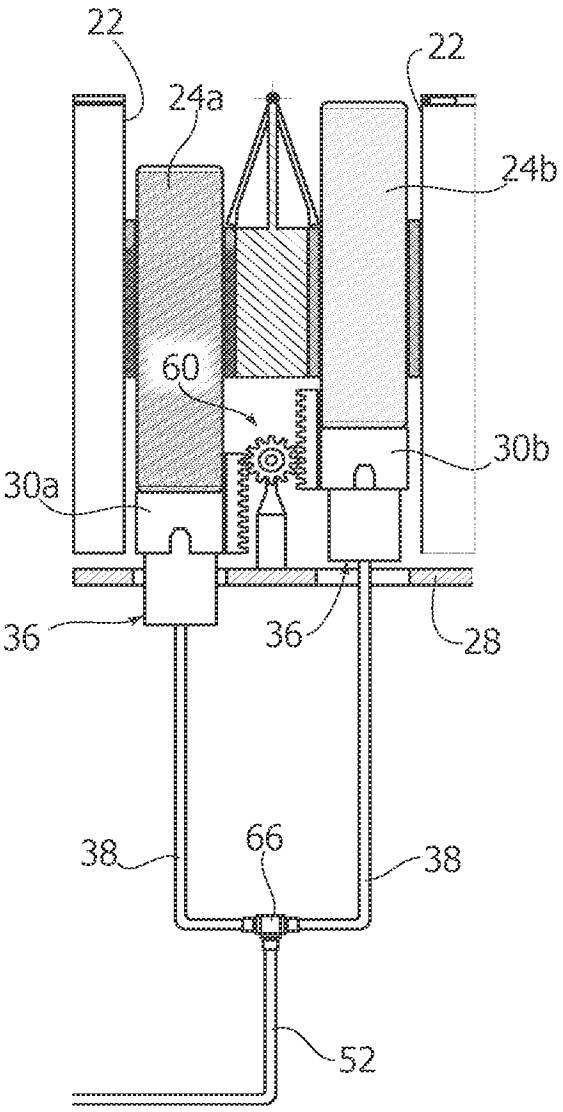

FIG. 11 illustrates the initial condition in which the cartridges 24*a* and 24*b* are both completely full. At this point, the dosing machine is ready to start working. At each dosage, the metered fluid product is withdrawn in an almost identical quantity from each of the two cartridges 24*a*, 24*b*. With reference to FIG. 12, the free surface of the liquid contained in the two cartridges, indicated by the line L, tends to assume the same level, except for a first step, wherein the free surface of the cartridge that is in the raised position is above the top of the cartridge located in the lowered position. As soon as the level of the cartridge located in the raised position falls below the top of the cartridge located in the lowered position, the liquid level in the two cartridges coincides and remains coincident until the cartridge located in the upper position is finished.

Figure 13:
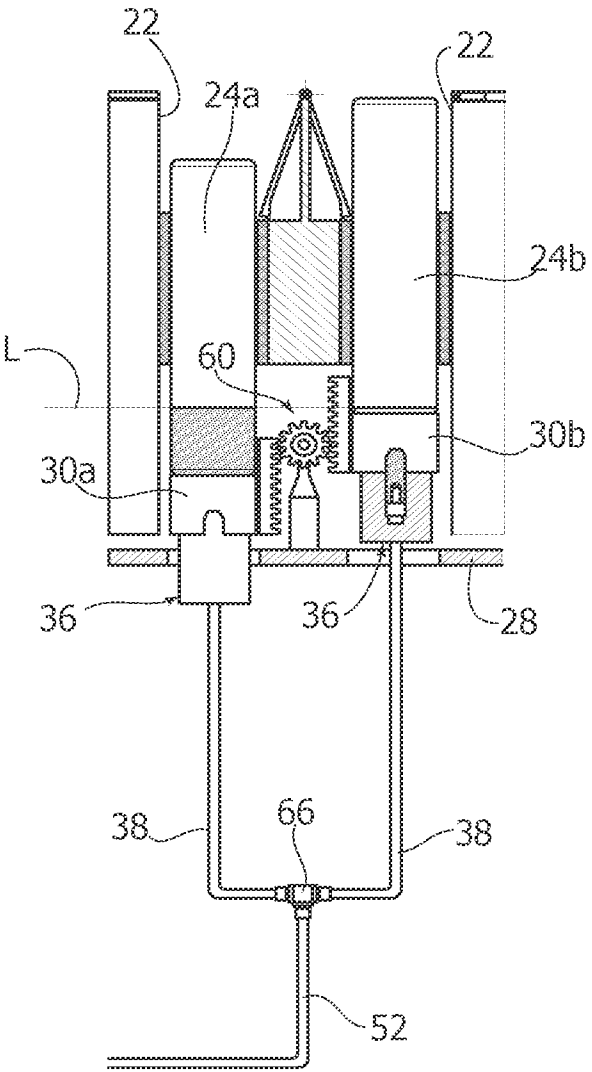
FIG. 13 illustrates the step wherein one of the cartridges is finished.

As the fluid product is withdrawn from the pair of cartridges 24*a*, 24*b*, the level L progressively decreases. When the level L reaches the bottom of the higher-located cartridge 24*b*, the level sensor 36 associated with the cartridge 24*b* signals to the control unit 58 that the cartridge is finished. The control unit activates a signal to indicate to the operator that the cartridge in question is finished. As illustrated in FIG. 13, when the uppermost cartridge (in this case the cartridge 24*b*) is finished, the lower-located cartridge (in this case the cartridge 24*a*) still contains a certain amount of liquid, which allows the machine to continue any dosage in progress. The control unit 58 can be configured in such a way that, once the dosage in progress is completed, an additional dosage is prevented until the empty complementary cartridge has been replaced. Thus, the bottom cartridge 24*a* constitutes a reserve buffer for the top cartridge 24*b*.

Figure 14:
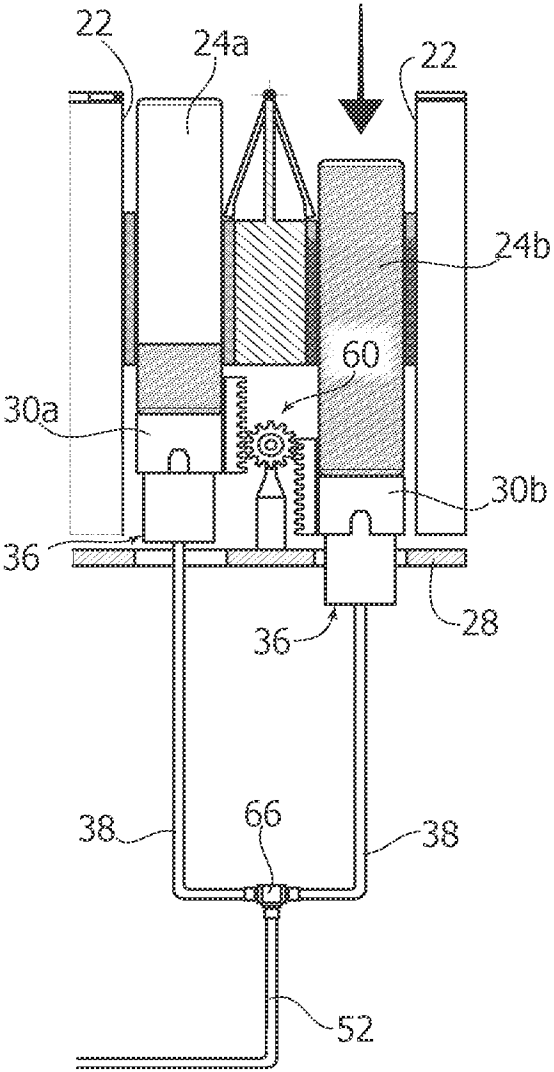
FIGS. 14 and 15 illustrate some operating steps following the replacement of an empty cartridge.
Figure 15:
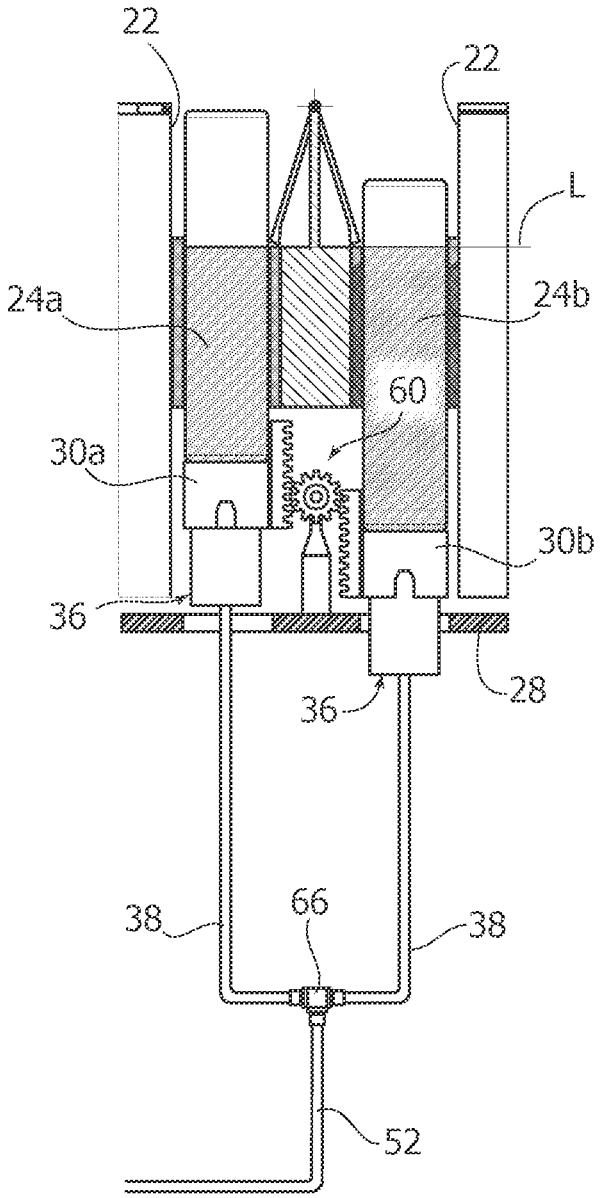

At this point, following the signal from the control unit 58, an operator replaces the uppermost empty cartridge with a new one. With reference to FIG. 14, the full cartridge 24*b* is inserted into the respective compartment 22 in place of the empty cartridge and is pushed downwards so as to engage it on the cartridge support 30*b*. In this way, the cartridge support 30*b* is pushed downwards and—at the same time—the cartridge support 30*a* and the cartridge 24*a* are moved upwards. The new just-replaced cartridge 24*b* then becomes the new buffer, and the role of the two cartridges is reversed. As a result of the principle of communicating vessels, after a period of time depending on the viscosity of the liquid, the levels of both cartridges 24*a*, 24*b* are realigned as shown in FIG. 15.

From this point on, the sequence repeats as described above with the cartridges reversing their high/low position each time an empty cartridge is replaced.

Both in the case in which the cartridge supports 30*a*, 30*b* are fixed, and in the case in which the cartridge supports 30*a*, 30*b* are vertically movable in opposite directions, the alternate replacement of the cartridges 24*a*, 24*b* avoids the formation of sedimentation, molds and aging of the fluid product (for example dye).

The dosing machine 10 may be provided with an optical signaling system including, for example, colored LEDs associated with each compartment 22, which can signal the status of the respective compartment. For example, this signaling may be carried out with lights of different colors, for example, green for an inserted and full cartridge, yellow for an inserted cartridge close to finishing, and red for an empty or missing cartridge.

Of course, without prejudice to the principle of the invention, the details of construction and the embodiments can be widely varied with respect to those described and illustrated, without thereby departing from the scope of the invention as defined by the claims that follow.

The invention claimed is:

1. A dosing machine for dispensing metered quantities of fluid products, comprising:

a stock having a plurality of compartments configured to receive respective sealed disposable cartridges, a dispensing head having a plurality of nozzles, and a plurality of dosing circuits configured to supply metered quantities of fluid products to respective nozzles of the plurality of nozzles of the dispensing head, wherein each dosing circuit of said plurality of dosing circuits is hydraulically connected to two cartridge supports configured to be connected to respective cartridges containing a same fluid product, so that, during operation, one of the two cartridges connected to a same dosing circuit forms a buffer for the other of the two cartridges, wherein said cartridge supports are fixed and are connected to respective tubes connected to two inlets of a three-way valve having an outlet connected to a metering pump, and wherein said three-way valve is controlled by a control unit according to signals corning from level sensors associated with said cartridge supports.

2. A dosing machine for dispensing metered quantities of fluid products, comprising:

a stock having a plurality of compartments configured to receive respective sealed disposable cartridges, a dispensing head having a plurality of nozzles, and a plurality of dosing circuits configured to supply metered quantities of fluid products to respective nozzles of the plurality of nozzles of the dispensing head, wherein each dosing circuit of said plurality of dosing circuits is hydraulically connected to two cartridge supports configured to be connected to respective cartridges containing a same fluid product, so that, during operation, one of the two cartridges connected to a same dosing circuit forms a buffer for the other of the two cartridges, and wherein said cartridge supports are movable in a vertical direction between a raised position and a lowered position, and vice versa.

3. The machine according to claim 2, wherein the two cartridge supports connected to the same dosing circuit are connected to each other by means of a transmission device which moves one of said two cartridge supports from a bottom upwards following a displacement from above downwards of the other cartridge support.

4. The machine according to claim 3, wherein said transmission device comprises two vertical racks fixed to respective cartridge supports and meshing with a gear rotatable about a fixed horizontal axis.

* * * * *